US005616043A

United States Patent [19]

Liou

[11] Patent Number: 5,616,043

[45] Date of Patent: Apr. 1, 1997

[54] VEHICLE ANTENNA CONNECTOR

[76] Inventor: Henry L.P. Liou, 20277 Valley Blvd., Apt. J, Walnut, Calif. 91789

[21] Appl. No.: 615,523

[22] Filed: Mar. 11, 1996

[51] Int. Cl.[6] ..... H01R 4/38

[52] U.S. Cl. ..... 439/322; 343/715; 343/906; 439/700

[58] Field of Search ..... 343/715, 906, 343/702; 439/322, 320, 218, 700, 824, 675, 578

[56] References Cited

U.S. PATENT DOCUMENTS

| | | | |
|---|---|---|---|
| 3,697,930 | 10/1972 | Shiney | 439/322 X |
| 4,173,761 | 11/1979 | Liautaud | 343/715 |
| 4,360,814 | 11/1982 | Wells | 343/715 X |
| 4,827,273 | 5/1989 | Friedberg et al. | 343/715 |
| 4,904,213 | 2/1990 | Hock et al. | 439/824 |
| 5,214,434 | 5/1993 | Hsu | 343/906 X |
| 5,233,363 | 8/1993 | Yarsunas et al. | 343/506 X |
| 5,502,452 | 3/1996 | Gomez | 343/906 X |

*Primary Examiner*—Donald T. Hajec
*Assistant Examiner*—Tho Phan
*Attorney, Agent, or Firm*—David & Raymond; Raymond Y. Chan

[57] ABSTRACT

A vehicle antenna connector includes a coupling housing, an adaptor and a loading device. The coupling housing has at least an outer connector member for connecting with an antenna element, a first hole section at bottom portion and a second section in the middle portion having a diameter smaller than the first hole section. A first inside female screw and a second inside female screw are formed in the first and second hole sections respectively. The adaptor, mounted on a base portion of the antenna element and connected with the coupling housing, has a contact member with a contact head extending into the coupling housing. The loading device is incorporated with the contact head and provides a pressing force to the contact member. In accordance with the vehicle antenna connector of the present invention, it not only can couple with both the UHF attachment base and the NMO attachment base, but also can provide better conduction contact effect.

11 Claims, 4 Drawing Sheets

VEHICLE ANTENNA CONNECTOR

BACKGROUND OF THE PRESENT INVENTION

The present invention relates to antennas installed on vehicles, and more particularly to a vehicle antenna connector having an adaptor capable of electrically connecting with both the UHF attachment base and the NMO attachment base.

Vehicle mounted antenna is usually designed to comprise two major parts, including an attachment base fastened on a vehicle and an antenna element coupling with the attachment base by means of a connector provided at the base portion of the antenna element.

It is well known that there are two major vehicle antenna systems established in today's radio antenna market. The essential different of the two vehicle antenna systems are the distinct configuration of their attachment bases, namely UHF attachment base and NMO attachment base.

FIG. 1 indicates a UHF attachment base 10 which comprises a cylindrical coupling head 11 vertically fastened to the central portion of a base 12. A male screw 111 is formed on the outer circumferential surface of the exposed upper portion of the coupling head 11 and the coupling head 11 has a central conductive hole 13. An antenna 14 having a specific type of antenna connector 15 provided at its base portion must be incorporated with the UHF attachment base 10 for electrically connecting the antenna 14 with the UHF attachment base 10 in order to secure good workability. Such specific antenna connector 15 is specially designed to match the cylindrical coupling head 11 and its central conductive hole 13, which comprises a coupling member 151 having a hollow core chamber 152 to receive the protruded coupling head 11. A female screw 153 is formed on the inside circumferential surface of the coupling member 15 for engaging with the male screw 111 of the coupling head 11. A conductive rod 16 having a diameter fitting the conductive hole 13 of the coupling head 11 is protruded from the center of the bottom of the coupling member 151 and extended to the core chamber 152 adapted to insert into the conductive hole 13 of the coupling head 11 for conductive connection.

FIG. 2 illustrates an NMO attachment base 20 which comprises a coupling platform 21 provided on the central portion of a seat 22. A male screw 211 is formed on the outer circumferential surface of the coupling platform 21. On the central portion of the coupling platform 21 protrudes a central conductive head 23. An antenna 24 having a specific type of antenna connector 25 provided at its base portion must be incorporated with the NMO attachment base 20 for electrically connecting the antenna 24 with the NMO attachment base 20 in order to secure good workability. Such specific antenna connector 25 is specially designed to match the coupling platform 21 and its central conductive head 23, which comprises a coupling sleeve 251 having a female screw 252 formed on its inside circumferential surface so that the coupling sleeve 251 is capable of engaging with the male screw 211 of the coupling platform 21. A short rigid conductive pin 26 is protruded from the center of the bottom surface of the coupling sleeve 251 adapted to keep firmly in contact with the conductive head 23 of the coupling platform 21 for conductive connection.

As described above, the above two structures produces the same effects but has the following shortcomings. The UHF antenna 14 is unable to fit the NMO attachment base 20 and, in opposite, the NMO antenna 24 does not match with the UHF attachment base 10. Both the UHF antenna 14 and the NMO antenna 24 are the unique structures for coupling connecting with the UHF attachment base 10 and the NMO attachment base 20 respectively. Accordingly, it causes unnecessary trouble in stock management and shipment to the manufacturers as well as the retailers. To the user, once the antenna is broken, he or she has to purchase the exact UHF or NMO type of antenna for replacement. Moreover, according to features of the conventional vehicle antenna device, no matter if it is the UHF or NMO antenna system, good conduction contact can only be achieved by very accurate constructive dimension. If the conductive rod 16 of the UHF antenna 14 or the conductive pin 26 of the NMO antenna 24 is merely slightly short, it will unable be in touch, i.e. in conductive contact, with the attachment base. However, if the conductive rod 16 of the UHF antenna 14 or the conductive pin 26 of the NMO antenna 24 is too long the antenna connector 15 or 25 is unable to firmly connected with the attachment base.

SUMMARY OF THE PRESENT INVENTION

The main object of the present invention is to provide a vehicle antenna connector capable of coupling with both the UHF attachment base and the NMO attachment base.

Another object of the present invention is to provide a vehicle antenna connector which can provide a pressing force for ensuring the best conductive connection of the antenna with the UHF attachment base as well as the NMO attachment base.

Accordingly, the present invention provides a vehicle antenna connector which comprises a coupling housing and an adaptor.

The coupling housing has at least an outer connector member for connecting with an antenna element and a central through hole having a first, a second and a third hole section of various inner diameters. The first hole section located at the bottom portion of the coupling housing has a largest inner diameter and a first inside female screw. The third hole section is located at the top portion of the coupling housing for firmly fastening the adaptor. The second hole section having a diameter smaller than the diameter of the first hole section is located between the first and third hole sections and has a second inside female screw.

The adaptor comprises a body, a loading device and a conductive contact member. The body has at least an end opening and a receiving chamber for receiving the loading device. The body is fastened to the third hole section of the coupling housing so as to enable the end opening coaxially confronting with the first and second hole sections. The contact member has a contact head extending into the coupling housing and is placed at the end opening of the body capable of moving up and down along the axis of the body. The loading device is incorporated with the contact member and provides a pressing force to the contact member so as to maintain its contact head extending into the first hole section. The contact head of the contact member is able to be compressed toward the other end of the body with a predetermined linear displacement until it is located in the second hole section of the coupling housing.

DETAILED DESCRIPTION OF THE PREFERRED EMBODIMENT

Figure 1:
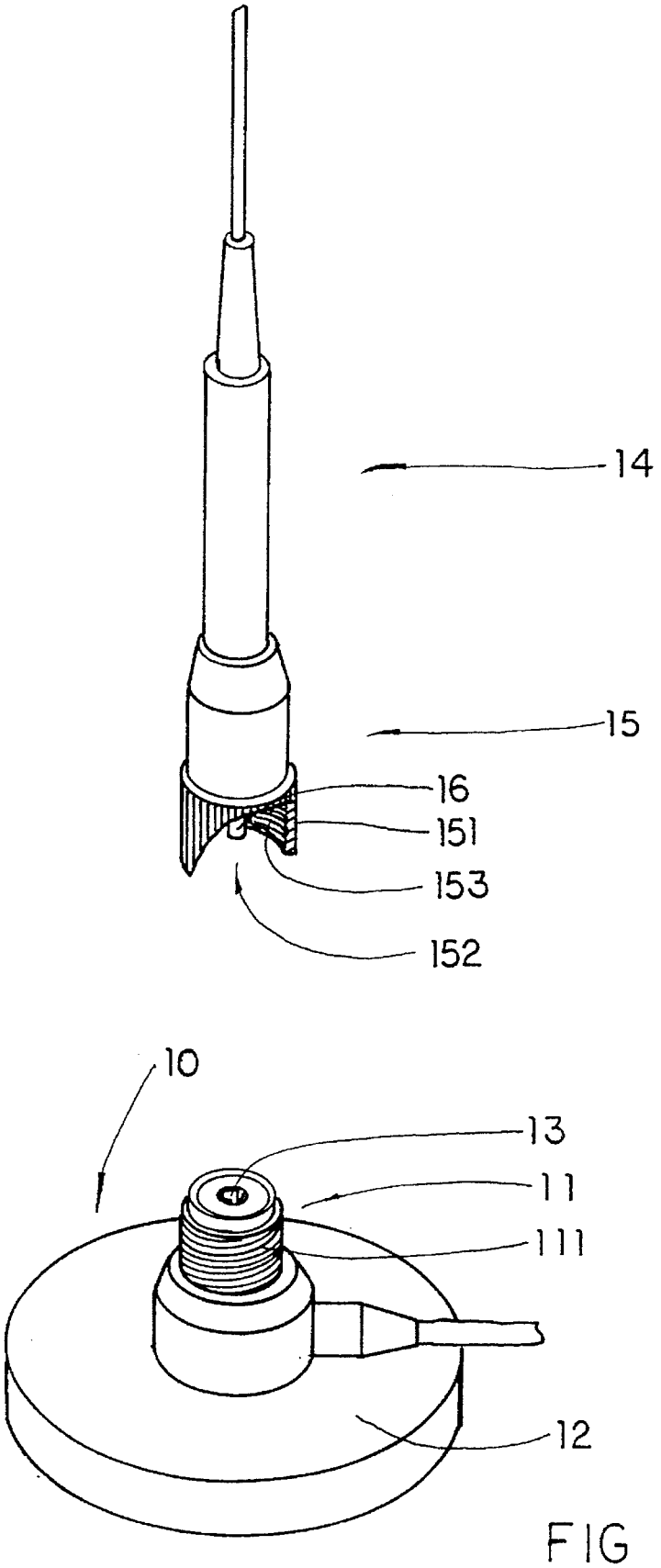
FIG 1 PRIOR ART
FIG. 1 is a perspective view of a conventional UHF attachment base and antenna.
Figure 2:
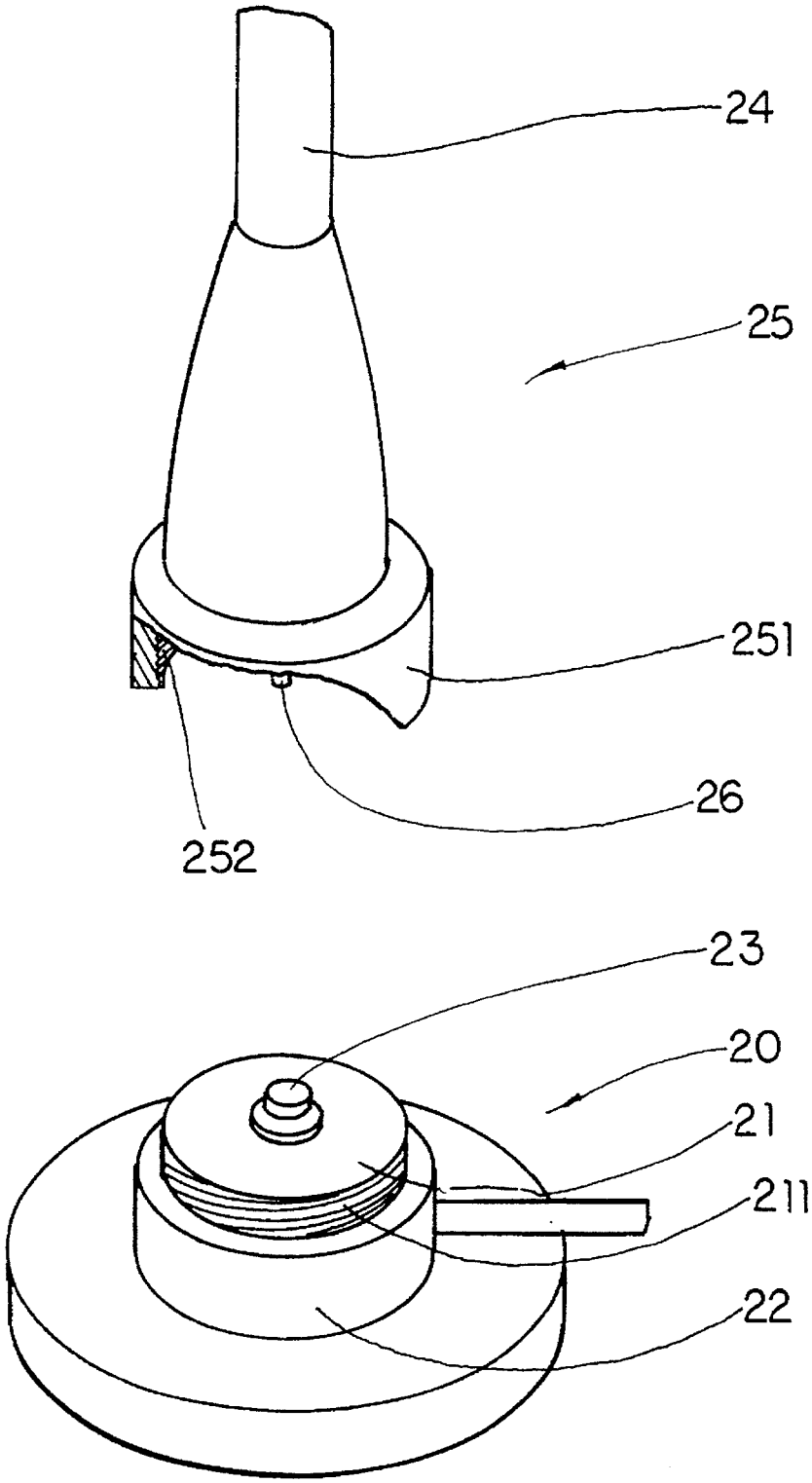
FIG 2 PRIOR ART
FIG. 2 is a perspective view of a conventional NMO attachment base and antenna.
Figure 3:
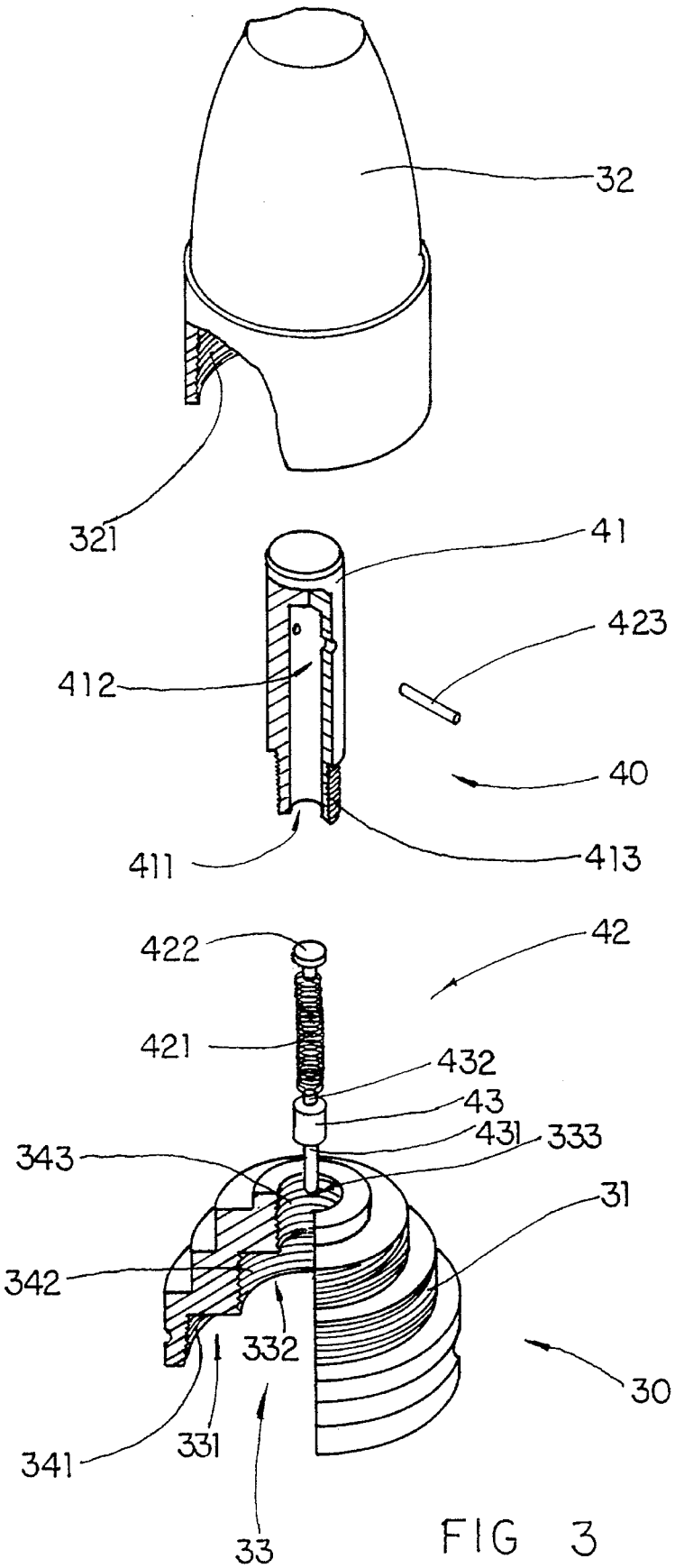
FIG. 3 is a sectional exposed perspective view of a vehicle antenna connector according to a preferred embodiment of the present invention.
Figure 4:
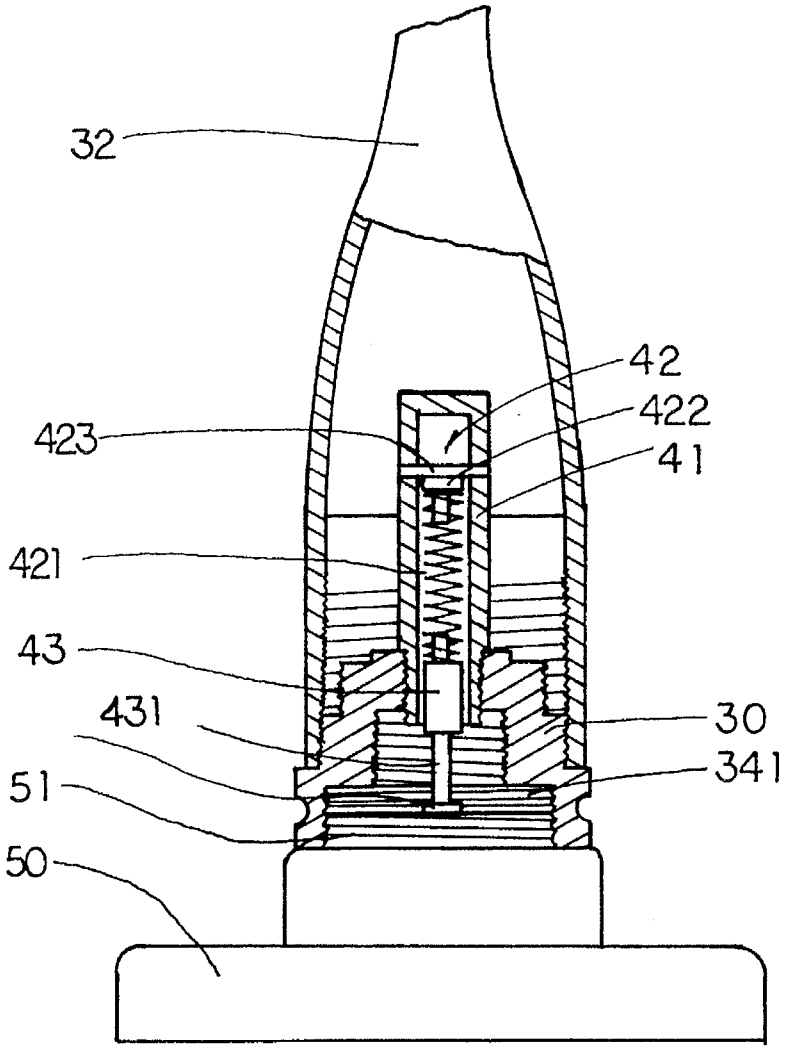
FIG. 4 is a sectional view of a vehicle antenna connector coupling with an NMO attachment base according to the above preferred embodiment of the present invention.
Figure 5:
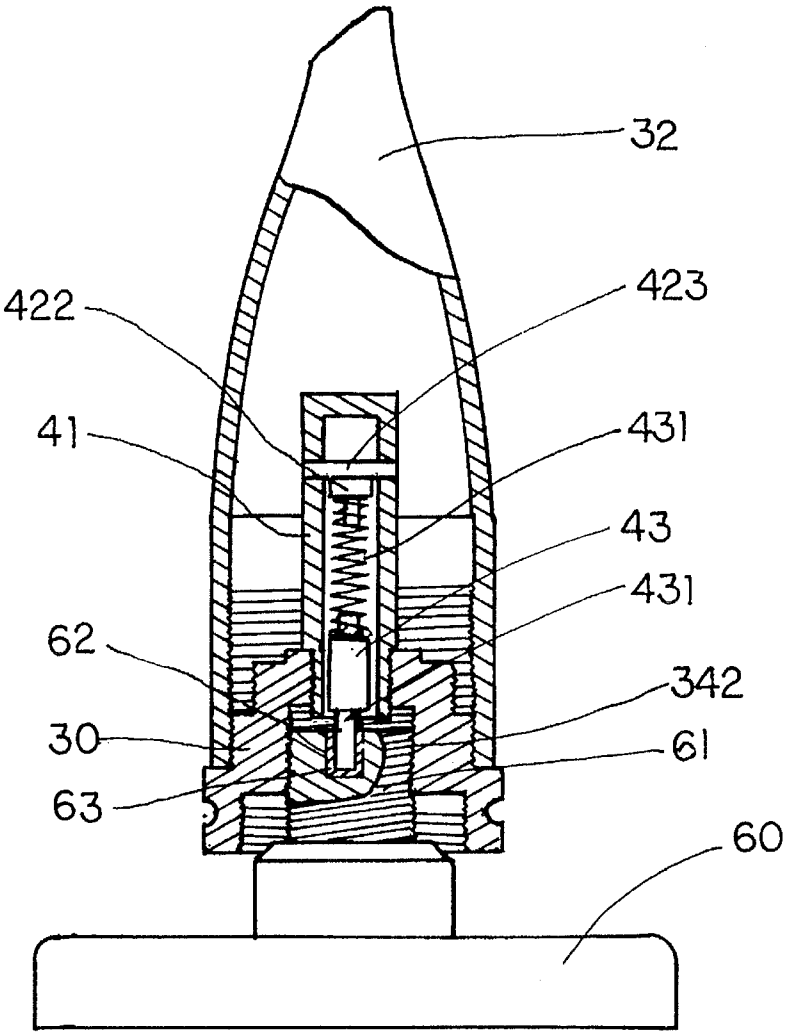
FIG. 5 is a sectional view of a vehicle antenna connector coupling with a UHF attachment base according to the above preferred embodiment of the present invention.

Referring to FIGS. 3 to 5 of the drawings, a vehicle antenna connector of the present invention comprises a coupling housing 30 and an adaptor 40.

The coupling housing 30 has at least an outer connector member 31 for connecting with an antenna element 32. The outer connector member 31 is an outer male screw formed on the outside circumferential surface of the coupling housing 30 and the base portion of the antenna element 32 has an inner female screw for engaging with the outer male screw 32 of the coupling housing 30.

The coupling housing 30 has a central through hole 33 defining a first, a second and a third section 331, 332, 333 of various inner diameters. The first hole section 331 located at the bottom portion of the coupling housing 30 has a largest inner diameter and a first inside female screw 341. The diameter of the first hole section 331 is equal to the standard diameter of a coupling platform 51 of an NMO attachment base 50 (as shown in FIG. 5). The third hole section 333 is located at the top portion of the coupling housing 30 for firmly fastening the adaptor 40. The third hole section 333 also has a third inside female screw 343. The second hole section 332 having a diameter smaller than the diameter of the first hole section 331 and larger than the diameter of the third hole section 333 is located between the first and third hole sections 331,333 and has a second inside female screw 342. The diameter of the second hole section 332 is equal to the standard diameter of a coupling head 61 of a UHF attachment base 60 (as shown in FIG. 4).

The adaptor 40 comprises a body 41, a loading device 42 and a conductive contact member 43. The body 41 has at least an end opening 411 and a receiving chamber 412 for receiving the loading device 42. The bottom portion of the body 40 forms an outer screw 413 having a diameter equal to the diameter of the third hole section 333 of the coupling housing 30 for firmly engaging with the third female screw 343 so as to fasten the adaptor 40 to the coupling housing 30 in such manner that the end opening 411 of the body 40 is coaxially confronted with the first and second hole sections 331,332.

The contact member 43 is made of conductive material and has a rod-form contact head 431 at one end and a mounting pin 432 at the other end. The contact head 431 is extended into the coupling housing 30 and is placed at the end opening 411 of the body 41 capable of moving up and down along the axis of the body 41.

The loading device 42 is incorporated with the contact member 43 and provides a pressing force to the contact member 43 so as to maintain the tip of its contact head 431 extending into the first hole section 331. The contact head 431 of the contact member 43 is able to be compressed toward the other end of the body 41 with a predetermined linear displacement until it is located in the second hole section 332 of the coupling housing 30.

In accordance with the present embodiment, the loading device 42 comprises a compressive spring 421 disposed within the receiving chamber 412 of the body 41. The compressive spring 421 makes the contact member 43 become a spring loaded contact member by inserting the mounting pin 432 to one end of the spring 421 so as to provide a compressive elastic force to the contact member 43.

The loading device 42 further comprises a stopper 422 and a locking pin 423 which is inserted into the receiving chamber 412 by passing through a transverse hole provided on a predetermined height of the body 41. The stopper 422 is disposed between the locking pin 423 and the other end of the spring 421 in order to support the spring 421 in desired position and enhance the compressive force of the spring 421.

As described above, the present of the loading device 42 enables the contact member 43 having a predetermined linear displacement and provides a pressing force to the contact member 43 which thus has a downward pressing tendency. Such features enable the vehicle antenna connector of the present invention coupling with the NMO attachment base 50. As shown in FIG. 4, The vehicle antenna connector of the present invention is connected with the NMO attachment base 50 by screwing the first female screw 341 of its coupling housing 30 onto the coupling platform 51. In this case, the contact member 43 is pressed by the spring 421 and the tip of the contact head 431 is pressed on a central conductive head 52 of the NMO attachment base 50 due to the pressing force provided by the spring 421 of the loading device 42 so that a good conduction contact can be ensured.

When the vehicle antenna connector of the present invention is applied to the UHF attachment base 60, as shown in FIG. 5, the antenna element 32 can be coupled with the UHF attachment base 60 by engaging the second female screw 342 of its coupling housing 30 with the coupling head 61 of the UHF attachment base 60. At the same time, the contact head 431 of the contact member 43 is inserted into a central conductive hole 62 provided on the coupling head 61 of the UHF attachment base 60. Since the length of the contact head 431 is longer than the depth of the conductive hole 62, the fully screwing connection of antenna connector of the present invention and the UHF attachment base 60 may cause the contact member 43 to be pressed by compressing the spring 421. Comparatively speaking, the contact head 431 maintains a pressing force on the bottom of the conductive tube 63 inside the conductive 63 and thus a better conduction contact can be ensured.

In accordance with the vehicle antenna connector of the present invention disclosed above, it not only can couple with both the UHF attachment base and the NMO attachment base, but also can provide better conduction contact effect. Moreover, the present invention is not limited to the aforesaid embodiment. Various modification can be made without departing from the spirit of the present invention.

I claim:

1. A vehicle antenna connector, comprising a coupling housing having at least an outer connector member for connecting with an antenna element and a central through hole having a first, a second and a third hole section, in which said first hole section located at a bottom portion of said coupling housing has a largest inner diameter and an inside first female screw, said third hole section is located at a top portion of said coupling housing, and said second hole section having a diameter smaller than the diameter of said first hole section is located between said first and third hole sections and has an inside second female screw;

an adaptor comprising a body, a loading device and a conductive contact member, said body having at least an end opening and a receiving chamber therein for receiving said loading device, said body being firmly fastened to said third hole section of said coupling housing so as to enable said end opening coaxially confronting with said first and second hole sections, said contact member being placed at said end opening of said body, capable of moving up and down along an axis of said body, and having a contact head extending into said coupling housing; and said loading device, disposed inside said receiving chamber of said body, incorporating with said contact member and providing a pressing force to said contact member to maintain its contact head extending into at least said first hole section and said second hole section, thereby said contact head of said contact member can be pressed toward another end of said body with a predetermined linear displacement until it is located in said second hole section of said coupling housing.

2. A vehicle antenna connector, as recited in claim 1, in which said connector member is an outer male screw formed on the outside circumferential surface of said coupling housing and a base portion of said antenna element has an inner female screw for engaging with said outer male screw of said coupling housing.

3. A vehicle antenna connector, as recited in claim 1, in which said third hole section also has a third inside female screw and a bottom portion of said body forms an outer screw having a diameter equal to the diameter of said third hole section for firmly engaging with said third female screw to fasten said adaptor to said coupling housing.

4. A vehicle antenna connector, as recited in claim 1, in which said contact member is made of conductive material and has a rod-form contact head at one end.

5. A vehicle antenna connector, as recited in claim 4, in which said contact member further has a mounting pin at the other end.

6. A vehicle antenna connector, as recited in claim 5, in which said loading device comprises a compressive spring, disposed within said receiving chamber of said body, making said contact member become a spring loaded contact member by inserting said mounting pin to one end of said compressive spring to provide a pressing force to said contact member.

7. A vehicle antenna connector, as recited in claim 6, in which said loading device further comprises a stopper which is disposed within said receiving chamber with one end thereof pressing on another end of said spring in order to support said spring in predetermined position and enhance the compressive force of said spring.

8. A vehicle antenna connector, as recited in claim 7, in which said loading device further comprises a locking pin which is inserted into said receiving chamber by passing through a transverse hole provided on a predetermined height of said body and said stopper is disposed between said locking pin and the another end of said spring.

9. A vehicle antenna connector, as recited in claim 8, in which said connector member is an outer male screw formed on the outside circumferential surface of said coupling housing and a base portion of said antenna element has an inner female screw for engaging with said outer male screw of said coupling housing.

10. A vehicle antenna connector as recited in claim 8, in which said third hole section also has a third inside female screw and a bottom portion of said body forms an outer screw having a diameter equal to the diameter of said third hole section for firmly engaging with said third female screw to fasten said adaptor to said coupling housing.

11. A vehicle antenna connector, as recited in claim 9, in which said third hole section also has a third inside female screw and a bottom portion of said body forms an outer screw having a diameter equal to the diameter of said third hole section for firmly engaging with said third female screw to fasten said adaptor to said coupling housing.

* * * * *